US011059251B2

(12) United States Patent
Kurokawa

(10) Patent No.: US 11,059,251 B2
(45) Date of Patent: Jul. 13, 2021

(54) PRESS SYSTEM AND CONTROL METHOD FOR PRESS SYSTEM

(71) Applicant: KOMATSU INDUSTRIES CORPORATION, Kanazawa (JP)

(72) Inventor: Takahiko Kurokawa, Nonoichi (JP)

(73) Assignee: KOMATSU INDUSTRIES CORPORATION, Kanazawa (JP)

( * ) Notice: Subject to any disclaimer, the term of this patent is extended or adjusted under 35 U.S.C. 154(b) by 332 days.

(21) Appl. No.: 15/571,544

(22) PCT Filed: Jul. 1, 2016

(86) PCT No.: PCT/JP2016/069623
§ 371 (c)(1),
(2) Date: Nov. 3, 2017

(87) PCT Pub. No.: WO2017/014026
PCT Pub. Date: Jan. 26, 2017

(65) Prior Publication Data

US 2018/0141299 A1 May 24, 2018

(30) Foreign Application Priority Data

Jul. 17, 2015 (JP) ..... JP2015-142977

(51) Int. Cl.
*B30B 15/28* (2006.01)
*B30B 15/14* (2006.01)
(Continued)

(52) U.S. Cl.
CPC ..... *B30B 15/28* (2013.01); *B30B 1/266* (2013.01); *B30B 15/10* (2013.01); *B30B 15/14* (2013.01);
(Continued)

(58) Field of Classification Search
CPC ..... B30B 15/10; B30B 15/14; B30B 15/142; B30B 15/148; B30B 15/16; B30B 15/166;
(Continued)

(56) References Cited

U.S. PATENT DOCUMENTS 4,023,044 A * 5/1977 Miller ..... B21D 55/00 307/116
4,633,720 A * 1/1987 Dybel ..... B21D 55/00 100/99
(Continued)

FOREIGN PATENT DOCUMENTS

JP S37-001637 B1 5/1962
JP H0641760 Y2 * 11/1994
(Continued)

OTHER PUBLICATIONS

Written Opinion dated Aug. 16, 2016 for PCT/JP2016/069623, including English language translation.

*Primary Examiner* — Adam J Eiseman
*Assistant Examiner* — Stephen Floyd London
(74) *Attorney, Agent, or Firm* — Faegre Drinker Riddle & Reath LLP

(57) ABSTRACT

A press system includes a detection unit configured to detect occurrence of an abnormality during press working for a workpiece, and an abnormality determination unit configured to determine an abnormality level, based on the abnormality detected by the detection unit and a stoppage period for which a pressing operation is stopped after occurrence of the abnormality.

9 Claims, 16 Drawing Sheets

(51) Int. Cl.
*B30B 1/26* (2006.01)
*B30B 15/10* (2006.01)
*H01H 47/00* (2006.01)

(52) U.S. Cl.
CPC ..... *B30B 15/148* (2013.01); *H01H 47/002* (2013.01)

(58) Field of Classification Search
CPC ..... B30B 15/26; B30B 15/28; B30B 15/285; F16P 3/008; F16P 7/00; F16P 7/02
USPC ..... 72/20.1, 20.2, 21.3, 31.11, 31.12; 700/206; 702/176, 177, 178
See application file for complete search history.

(56) References Cited

U.S. PATENT DOCUMENTS 4,987,528 A * 1/1991 O'Brien ..... B30B 15/0094 700/79
5,224,053 A * 6/1993 Cook ..... B30B 15/26 340/3.43
5,327,349 A * 7/1994 Hoste ..... G05B 19/41875 700/110
5,692,404 A * 12/1997 Kirii ..... B21D 24/00 72/15.1
6,237,479 B1 * 5/2001 Douba ..... B30B 1/186 100/43
6,675,079 B2 1/2004 Kwon
6,859,898 B1 2/2005 Yamashita et al.
8,134,725 B2 3/2012 Hasegawa
2003/0116037 A1 * 6/2003 Tanaka ..... B30B 15/26 100/282
2004/0176868 A1 9/2004 Haga et al.
2011/0090040 A1 * 4/2011 Allen ..... F16P 3/147 340/3.1

FOREIGN PATENT DOCUMENTS

JP H08-314539 A 11/1996
JP H09-314259 A 12/1997
JP 2000-6854 A 1/2000
JP 2000-042795 A 2/2000
JP 2001-100817 A 4/2001
JP 2004-36506 A 2/2004
JP 3650810 B2 5/2005
JP 3769915 B2 * 4/2006 ..... B30B 15/10
JP 3913488 B2 5/2007
JP 4044443 B2 2/2008
JP 4555346 B2 9/2010
JP 4794904 B2 10/2011
JP 5537138 B2 7/2014
WO WO-2006/066276 A2 6/2006
WO WO-2013136915 A1 * 9/2013

* cited by examiner

FIG.15

| | EXAMPLES OF ABNORMALITY TYPE |
|---|---|
| ABNORMALITY LEVEL A | ENCODER ABNORMALITY |
| ABNORMALITY LEVEL B | OVERLOAD ABNORMALITY |
| ABNORMALITY LEVEL C | BATTERY ABNORMALITY |

PRESS SYSTEM AND CONTROL METHOD FOR PRESS SYSTEM

TECHNICAL FIELD

The present invention relates to press systems, and particularly to press systems for pressing a workpiece.

BACKGROUND ART

Conventionally, in a servo feeder apparatus of a transfer press, for example, a controller controlling a servo motor constantly monitors state amounts of a servo system (such as deviation, amount of deviation between shafts, amplifier abnormality, overrun, sensor abnormality, state amounts relating to system security, and the like). When the controller detects an abnormal state in which these state amounts exceed preset ranges, the controller performs a process for addressing the abnormality. Specifically, the controller causes an external display to present this abnormal state and stops the apparatus.

Regarding this, a system that stores data indicating a state of an abnormality so as to use the data for an analysis is known from Japanese Patent Laying-Open Nos. 9-314259 and 2000-6854 for example.

In a press machine, an abnormal state is likely to occur depending on the state of press working. Moreover, when one abnormality occurs, a plurality of relevant abnormalities may occur. It is therefore important to distinguish abnormality levels from each other.

Regarding this, Japanese Patent Laying-Open No. 2004-36506 proposes a system that analyzes the frequency at which an abnormal event occurs and stores data on an abnormal event occurring at a higher frequency, prior to storing data on an abnormal event occurring at a lower frequency.

CITATION LIST

Patent Document

PTD 1: Japanese Patent Laying-Open No. 9-314259
PTD 2: Japanese Patent Laying-Open No. 2000-6854
PTD 3: Japanese Patent Laying-Open No. 2004-36506

SUMMARY OF INVENTION

Technical Problem

In a press system, however, a high frequency of occurrence of an abnormal event does not enable a determination to be made as to whether the degree of importance of the abnormality is high or not. Even when the frequency of occurrence of an abnormal event is high, the degree of importance of the abnormality may be low.

The present invention has been made to solve the above-described problem, and an object of the present invention is to provide a press system and a control method for the press system that enable levels of abnormalities to be distinguished from each other by a simple system.

Solution to Problem

A press system according to an aspect includes: a detection unit configured to detect occurrence of an abnormality during press working for a workpiece; and an abnormality determination unit configured to determine an abnormality level, based on the abnormality detected by the detection unit and a stoppage period for which a pressing operation is stopped after occurrence of the abnormality.

According to the present invention, the abnormality level is determined based on the stoppage period for which the pressing operation is stopped after occurrence of the abnormality, which enables the abnormality level to be determined by the simple system.

Preferably, the press system further includes an abnormality notification unit configured to give a notification of at least one of the abnormality and the abnormality level, based on a result of determination by the abnormality determination unit.

According to the present invention, a notification of at least one of the abnormality and the abnormality level is given based on the result of determination by the abnormality determination unit, which enables at least one of the abnormality and the abnormality level to be recognized.

Preferably, the press system further includes an abnormality storage unit configured to store abnormality data, based on a result of determination by the abnormality determination unit.

According to the present invention, the abnormality data is stored based on the result of determination by the abnormality determination unit to thereby enable storage of data on an abnormality having a high abnormality level, which enables reduction of a memory capacity to be ensured.

Preferably, the press system further includes an abnormality type determination unit configured to determine an abnormality type of the abnormality detected by the detection unit. The abnormality storage unit is configured to store the abnormality data based on a result of determination by the abnormality type determination unit and a result of determination by the abnormality determination unit.

According to the present invention, the abnormality data is stored based on the results of determination by the abnormality type determination unit and the abnormality determination unit, which enables efficient storage of abnormality data.

Preferably, the abnormality storage unit includes: an inquiry unit configured to make an inquiry about whether to store the abnormality data in accordance with a result of determination by the abnormality determination unit; and an execution unit configured to execute a storage process of storing the abnormality data in accordance with an instruction given by a user to the inquiry unit.

According to the present invention, an inquiry is made to a user about whether to store abnormality data so as to confirm the user's intention to store the data and to store the abnormality data following the instruction, which enables reliable storage of abnormality data while reflecting the user's intention.

Preferably, the press system further includes a count unit configured to count the stoppage period for which the pressing operation is stopped. When a predetermined pressing operation is performed, the count unit does not stop counting the stoppage period.

According to the present invention, when a predetermined pressing operation is performed, the counting is not stopped. Accordingly, erroneous determination of the abnormality level, due to a predetermined pressing operation that is not restart (recovery) of the operation, can be prevented, and the determination can be made with higher accuracy.

A control method for a press system according to an aspect includes: receiving an abnormality occurrence signal during press working for a workpiece; and determining an abnormality level based on the received abnormality occurrence signal and information about a stoppage period for which a pressing operation is stopped after generation of the abnormality occurrence signal.

According to the present invention, the abnormality level is determined based on the stoppage period for which the pressing operation is stopped after occurrence of the abnormality, which enables determination of the abnormality level by the simple system.

Preferably, the control method further includes transmitting notification instruction data for issuing an instruction to give a notification of at least one of an abnormality and the abnormality level, based on a result of the determining.

According to the present invention, the notification instruction data is transmitted to give a notification of at least one of the abnormality and the abnormality level based on the result of determination, which enables at least one of the abnormality and the abnormality level to be recognized.

Advantageous Effects of Invention

The press system of the present invention and the control method for the press system enable levels of abnormalities to be distinguished from each other by a simple system.

BRIEF DESCRIPTION OF DRAWINGS

FIG. 15 is a diagram illustrating classification of abnormality types according to the third embodiment.

DESCRIPTION OF EMBODIMENTS

Figure 1:
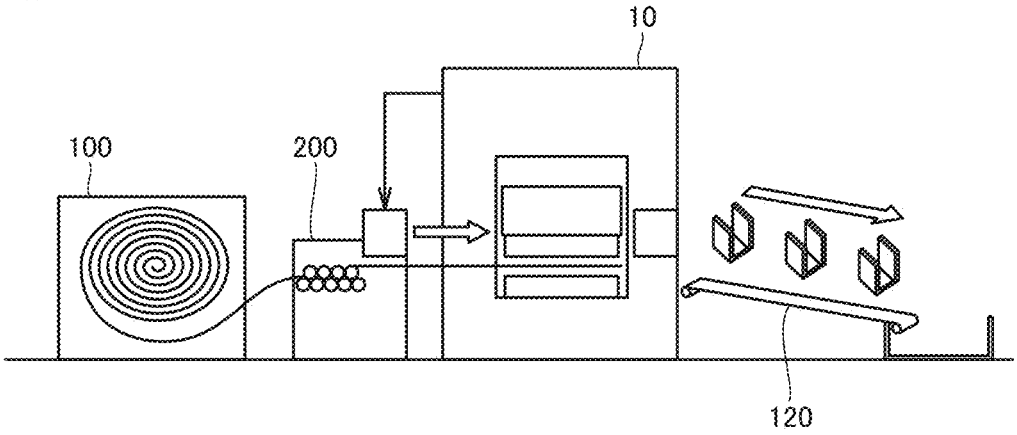
FIG. 1 is a diagram illustrating a configuration of a press system according to a first embodiment.

Embodiments will be described in detail with reference to the drawings. In the drawings, the same or corresponding parts are denoted by the same reference characters, and a description thereof will not be repeated.

In the present example, a progressive-type press machine will be described as an example of the press machine.

First Embodiment

<Overall Configuration>

FIG. 1 is a diagram illustrating a configuration of a press system according to a first embodiment.

As shown in FIG. 1, the press system includes a uncoiler 100, a leveler feeder 200, a press machine 10, and a transport conveyer 120.

A coil is wound around uncoiler 100, and the coil is transported through leveler feeder 200 to press machine 10. In the present example, press working for the coil as a workpiece (material) will be described.

Leveler feeder 200 adjusts the feed height of the coil transported from uncoiler 100 to press machine 10, and also transports the coil to press machine 10 at a predetermined timing.

Press machine 10 performs press working for the coil transported from leveler feeder 200 in accordance with selected forming conditions (press motion).

Transport conveyer 120 transports a workpiece formed by press working with press machine 10. For example, transport conveyer 120 can also transport the workpiece to a subsequent press machine.

The parts of the press system are synchronized with one another, and a series of operations is successively performed. The coil is transported from uncoiler 100 to press machine 10 through leveler feeder 200. The workpiece undergoing press working by press machine 10 is transported by transport conveyer 120. The above-described series of operations is repeated.

The above configuration of the press system is given by way of example, and the configuration of the press system is not limited to this.

<Press Machine>

Figure 2:
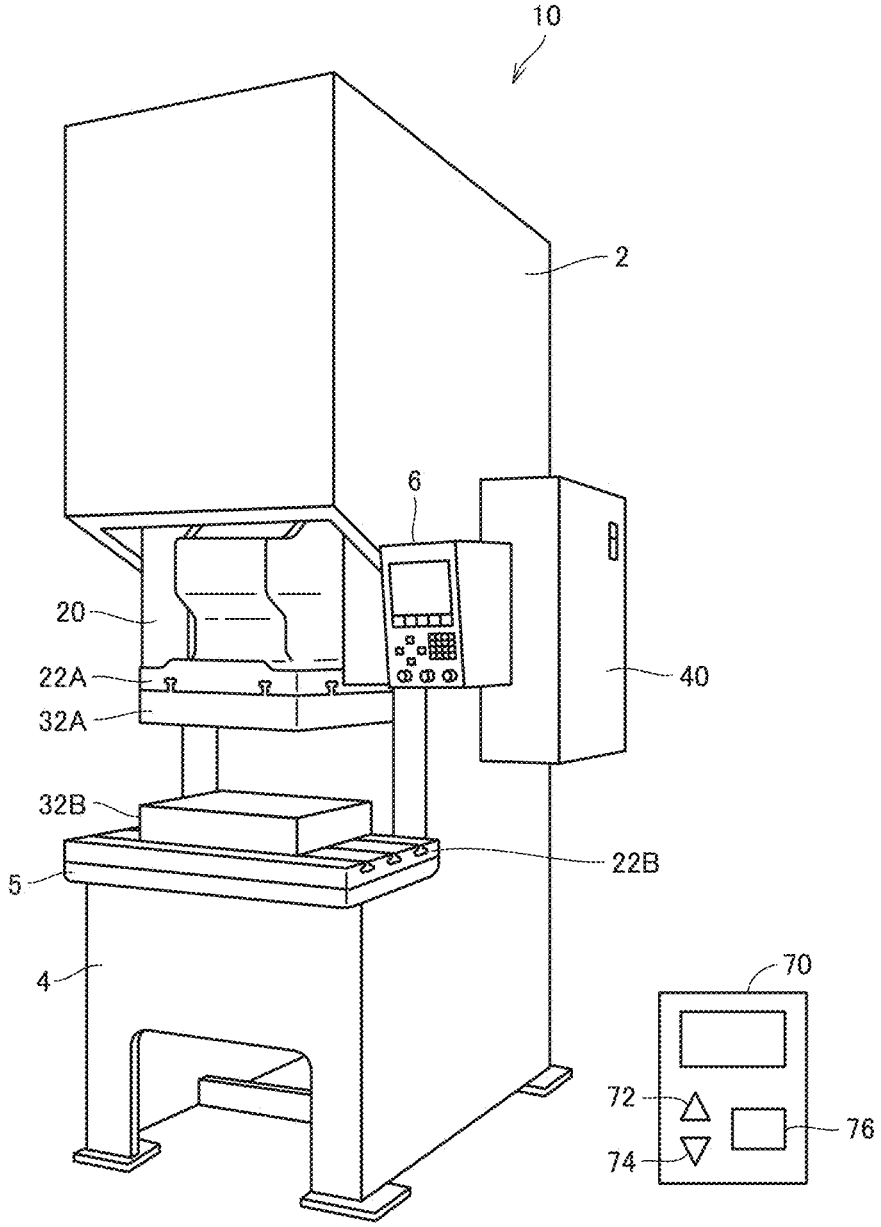
FIG. 2 is a perspective view of a press machine 10 according to the first embodiment.

FIG. 2 is a perspective view of press machine 10 according to the first embodiment.

As shown in FIG. 2, the press machine of the progressive type is illustrated by way of example. In the present example, a servo press serving as press machine 10 is illustrated.

Press machine 10 includes a body frame 2, a slide 20, a bed 4, a bolster 5, a control panel 6, and a controller 40.

At a substantially central position of body frame 2 of press machine 10, slide 20 is supported to be movable up and down. Below slide 20, bolster 5 attached on bed 4 is disposed. At a front portion of body frame 2, control panel 6 is disposed. On a lateral side of body frame 2, controller 40 to which control panel 6 is connected is disposed.

On the lower surface of slide 20, a bolster plate 22A is mounted for fixing a die. An upper die 32A of a die set is attached to bolster plate 22A. On the upper surface of bolster 5, a bolster plate 22B is mounted for fixing a die. A lower die 32B of the die set for processing a workpiece is attached to bolster plate 22B. A given workpiece to be pressed by the dies is positioned on lower die 32B and upper die 32A is lowered with slide 20 to press the workpiece.

A remote controller 70 configured to be capable of communicating with press machine 10 and remotely controllable from the outside is also provided. Remote controller 70 can be operated to make various settings. Remote controller 70 is capable of communicating with controller 40 to cause press machine 10 to operate following instructions from remote controller 70.

In the present example, remote controller 70 equipped with an upward button 72 and a downward button 74 capable of causing the slide to move upward and downward as well as a mode switch button 76 capable of causing the operation mode to be switched is illustrated. For example, mode switch button 76 can be selected to switch a production mode in which normal press working is performed to an inching operation mode in which an inching operation can be performed, by way of example. In the inching operation mode, upward button 72 and downward button 74 can be operated to move the slide upward/downward so as to adjust the height of the slide position. In the present example, a description is given of the case where remote controller 70 is used to cause the inching operation to be performed, by way of example. Control may also be performed by means of control panel 6 described later therein, without particularly using remote controller 70.

Control panel 6 is used for entering various types of data necessary for controlling press machine 10, and includes switches and ten keys for entering data as well as a display for indicating a settings screen and data which is output from press machine 10.

As the display, a programmable display having a clear touch switch panel mounted on the front face of a graphic display such as liquid crystal display or plasma display is used.

Control panel 6 may also include a data input device for data from an external storage medium such as IC card on which data set in advance is stored, or include a communication device for transmitting/receiving data in the wireless manner or through a communication line.

In the present example, while the description is given of the configuration of press machine 10 equipped with control panel 6 and remote controller 70, the above-described configuration of the press machine is given by way of example, not by way of limitation. For example, the press machine may be equipped with only one of the control panel and the remote controller.

Figure 3:
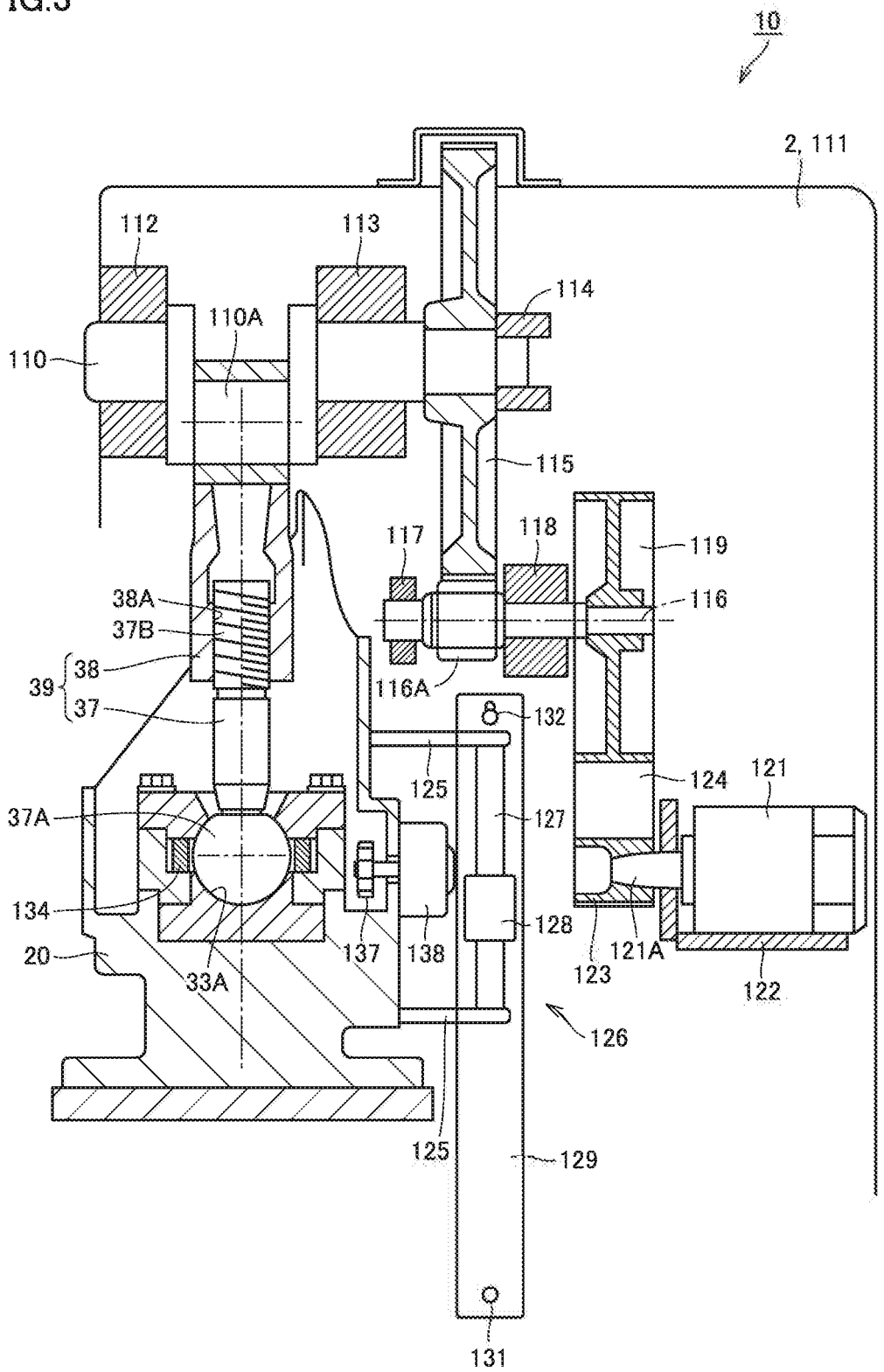
FIG. 3 is a side cross-sectional view showing principal parts of press machine 10.

FIG. 3 is a side cross-sectional view showing principal parts of press machine 10.

Figure 4:
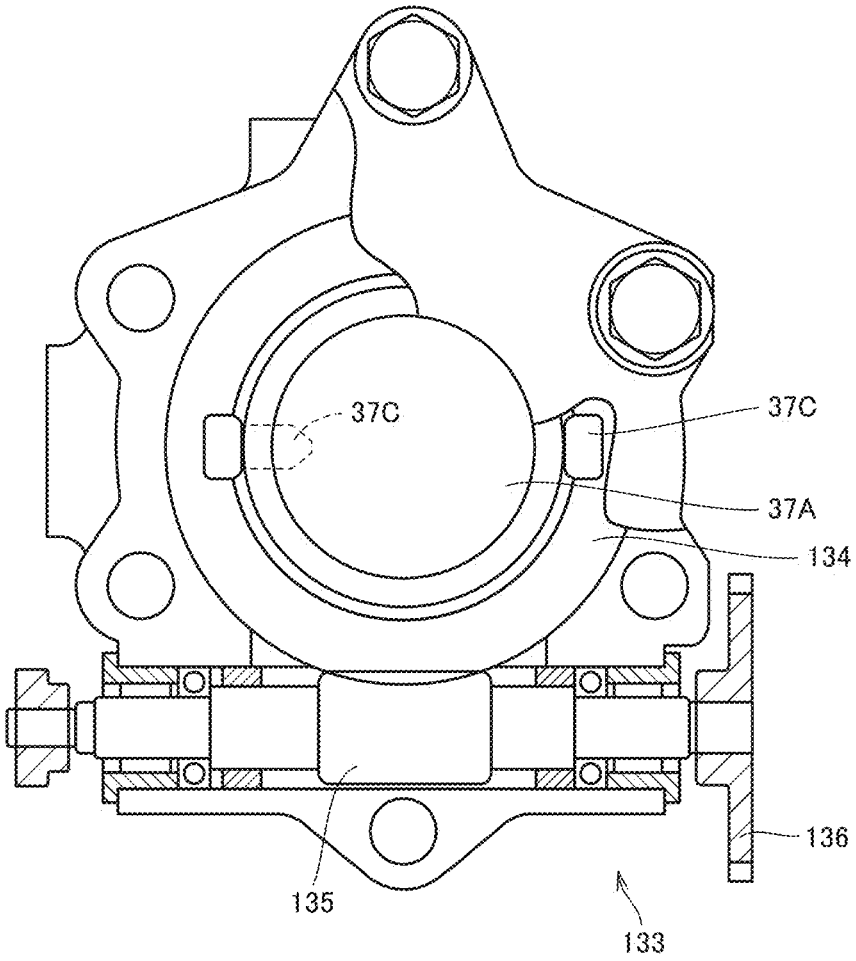
FIG. 4 is a plan view of a partial cross section showing other principal parts of press machine 10.

FIG. 4 is a plan view of a partial cross section showing other principal parts of press machine 10.

As shown in FIG. 3, press machine 10 is a servo press and includes a servo motor 121, a spherical hole 33A, a screw shaft 37, a sphere 37A, a thread 37B, a connecting rod body 38, a female thread 38A, a connecting rod 39, a main shaft 110, an eccentric portion 110A, a side frame 111 of the frame body 2, bearings 112 to 114, a main gear 115, a power transmission shaft 116, a transmission gear 116A, bearings 117, 118, and a pulley 119.

In press machine 10, servo motor 121 drives slide 20. In spherical hole 33A formed in an upper portion of slide 20, sphere 37A for adjusting the die height is rotatably inserted in such a manner that prevents sphere 37A disposed at the lower end of screw shaft 37 from falling out. Spherical hole 33A and sphere 37A form a spherical joint. Thread 37B of screw shaft 37 is exposed upward from slide 20 and screwed in female thread 38A of connecting rod body 38 disposed above screw shaft 37. Screw shaft 37 and connecting rod body 38 form extendable connecting rod 39.

The die height refers to the distance from the lower surface of the slide to the upper surface of the bolster with slide 20 set at the bottom dead center.

An upper portion of connecting rod 39 is rotatably coupled to crank-shaped eccentric portion 110A disposed on main shaft 110. Main shaft 110 is supported between a pair of right and left thick-plate-shaped side frames 111 which form body frame 2, by bearings 112, 113, 114 arranged at respective three positions in the front-rear direction. To the rear side of main shaft 110, main gear 115 is attached.

Main gear 115 meshes with transmission gear 116A of power transmission shaft 116 disposed below main gear 115. Power transmission shaft 116 is supported between side frames 111 by bearings 117, 118 arranged at respective two positions in the front-rear direction. To the rear end of power transmission shaft 116, pulley 119 to be driven is attached. Pulley 119 is driven by servo motor 121 disposed below pulley 119.

Press machine 10 further includes a bracket 122, an output shaft 121A, a pulley 123, a belt 124, a bracket 125, a position detector 126, a rod 127, a position sensor 128, an auxiliary frame 129, and bolts 131, 132.

Servo motor 121 is supported between side frames 111 with substantially L-shaped bracket 122 located therebetween. Output shaft 121A of servo motor 121 protrudes in the front-rear direction of press machine 10. Motive power is transmitted by belt 124 wound around driver pulley 123 and driven pulley 119 disposed on output shaft 121A.

To the back side of slide 20, a pair of brackets 125 is attached that protrude rearward from two positions, namely the upper position and the lower position, toward the space between side frames 111. Between upper and lower brackets 125, rod 127 forming a part of position detector 126 such as linear scale is attached. This rod 127 is equipped with a scale for detecting the position in the top-bottom direction of slide 20, and inserted to be movable up and down through position sensor 128 which also forms a part of position detector 126. Position sensor 128 is secured to auxiliary frame 129 disposed on one side frame 111.

Auxiliary frame 129 is formed in a vertically elongate shape, has its lower portion attached to side frame 111 with bolt 131 and its upper portion supported slidably up and down with bolt 132 which is inserted in a vertically long hole. Thus, only one of the upper side and the lower side (the lower side in the present embodiment) of auxiliary frame 129 is secured to side frame 111, and the other side thereof is supported movably up and down. Therefore, auxiliary frame 129 is not influenced by elongation/contraction, due to temperature variation, of side frames 111. In this way, position sensor 128 is capable of accurately detecting the slide position and the die height position without being influenced by such elongation/contraction of side frames 111.

In contrast, the slide position of slide 20 and the die height are adjusted by a slide position adjustment mechanism 133 disposed in slide 20. As also shown in FIG. 4, slide position adjustment mechanism 133 includes a warm wheel 134 attached to the outer periphery of sphere 37A of screw shaft 37 with a pin 37C, a warm gear 135 meshing with warm wheel 134, an input gear 136 attached to an end of warm gear 135, and an induction motor 138 having an output gear 137 meshing with input gear 136. Induction motor 138 has a flat shape having a relatively shorter axial length and is formed compactly. Rotational motion of induction motor 138 is adjusted by rotating screw shaft 37 through warm wheel 134.

<Configuration of Press Machine>

Figure 5:
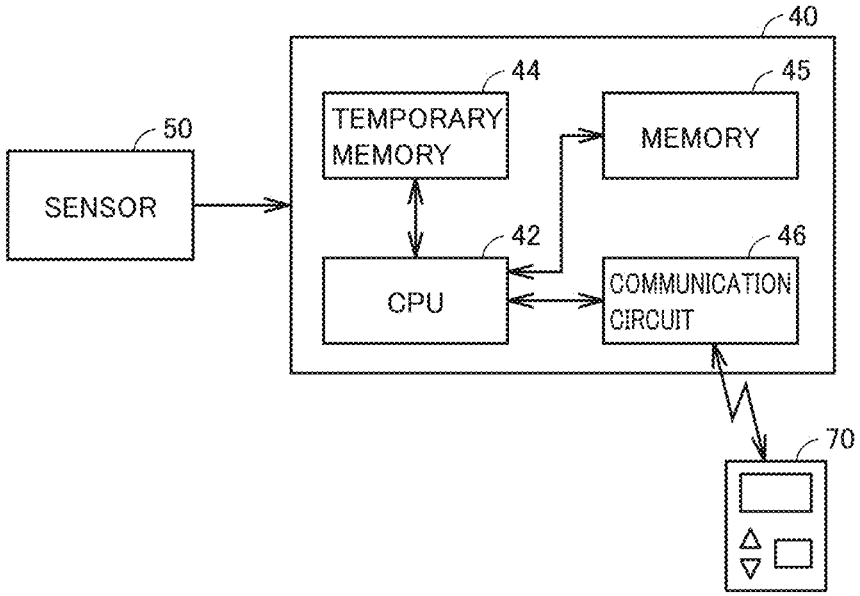
FIG. 5 is a diagram illustrating a part of a configuration of press machine 10 according to the first embodiment.

FIG. 5 is a diagram illustrating a part of the configuration of press machine 10 according to the first embodiment.

Referring to FIG. 5, controller 40 includes a CPU (Central Processing Unit) 42, a temporary memory 44, a memory 45, and a communication circuit 46.

Remote controller 70 configured to be capable of communicating with controller 40 is also provided.

Press machine 10 also includes a sensor 50 configured to detect an abnormality.

Controller 40 receives input of a detection signal from sensor 50 detecting an abnormality of press machine 10. While one sensor is described as a sensor configured to detect an abnormality of press machine 10, the sensor is not limited to this and press machine 10 may include a plurality of sensors configured to detect various kinds of abnormalities of press machine 10.

Communication circuit 46 is configured to be capable of communicating with remote controller 70. Communication circuit 46 is also capable of communicating data with an external device through a network.

CPU 42 controls the whole press machine 10 based on various programs stored in memory 45.

As temporary memory 44, a circulation-type ring buffer is used by way of example. Temporary memory 44 stores state amounts of press machine 10 at sampling intervals set in advance by way of example. The state amounts of press machine 10 include a state amount of a servo system, an eccentricity amount of the slide, and a state amount involved in security of the press machine such as press load value.

The state amounts are successively stored at sampling intervals in temporary memory 44, and therefore, not only state amounts of press machine 10 after occurrence of an abnormality but also state amounts of press machine 10 before the occurrence of the abnormality can be acquired.

In the present example, use of the circular-type ring buffer as temporary memory 44 is described. The temporary memory is not particularly limited to this, but may be of stack type. The form of the temporary memory is not particularly limited.

Memory 45 is a storage unit storing various programs of press machine 10, and also stores abnormality data stored in temporary memory 44.

<Functional Configuration of Controller 40 of Press Machine>

Figure 6:
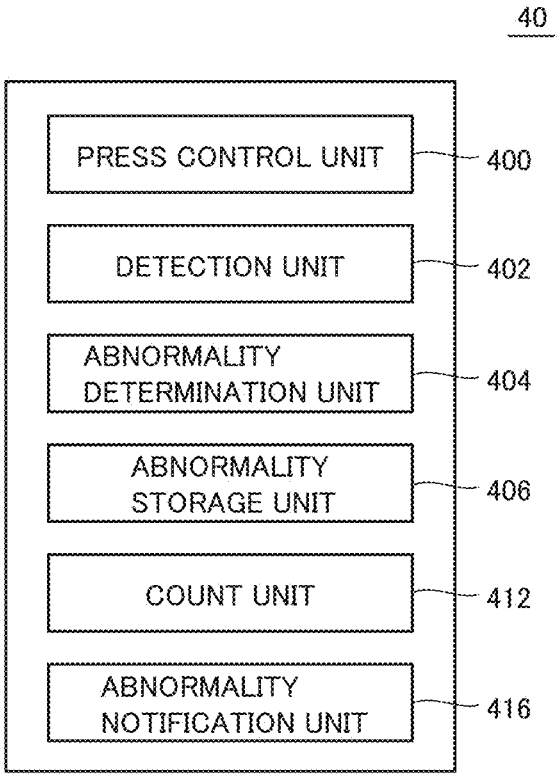
FIG. 6 is a diagram illustrating functional blocks of a controller 40 according to the first embodiment.

FIG. 6 is a diagram illustrating functional blocks of controller 40 according to the first embodiment.

As shown in FIG. 6, controller 40 includes a press control unit 400, a detection unit 402, an abnormality determination unit 404, an abnormality storage unit 406, a count unit 412, and an abnormality notification unit 416.

Press control unit 400 controls the whole machine. For example, based on a predetermined motion program stored in memory 45, press control unit 400 controls the servo system to cause press working to be performed in the production mode. Press control unit 400 also causes the inching operation to be performed in the inching operation mode following an instruction.

Detection unit 402 detects an abnormality of press machine 10 based on a detection signal from sensor 50, by way of example.

Abnormality determination unit 404 determines an abnormality level of an abnormality of press machine 10 detected by detection unit 402.

Abnormality storage unit 406 stores abnormality data based on the result of the determination by abnormality determination unit 404. Specifically, abnormality data stored in temporary memory 44 is stored in memory 45.

Count unit 412 counts a period for which a pressing operation is stopped after occurrence of an abnormality.

Abnormality notification unit 416 gives a notification of at least one of an abnormality and an abnormality level based on the result of the determination by abnormality determination unit 404.

<Specific Examples of Abnormality Determination>

FIGS. 7A, 7B, and 7C are diagrams illustrating specific examples of abnormality determination for press machine 10 according to the first embodiment.

Figure 7:
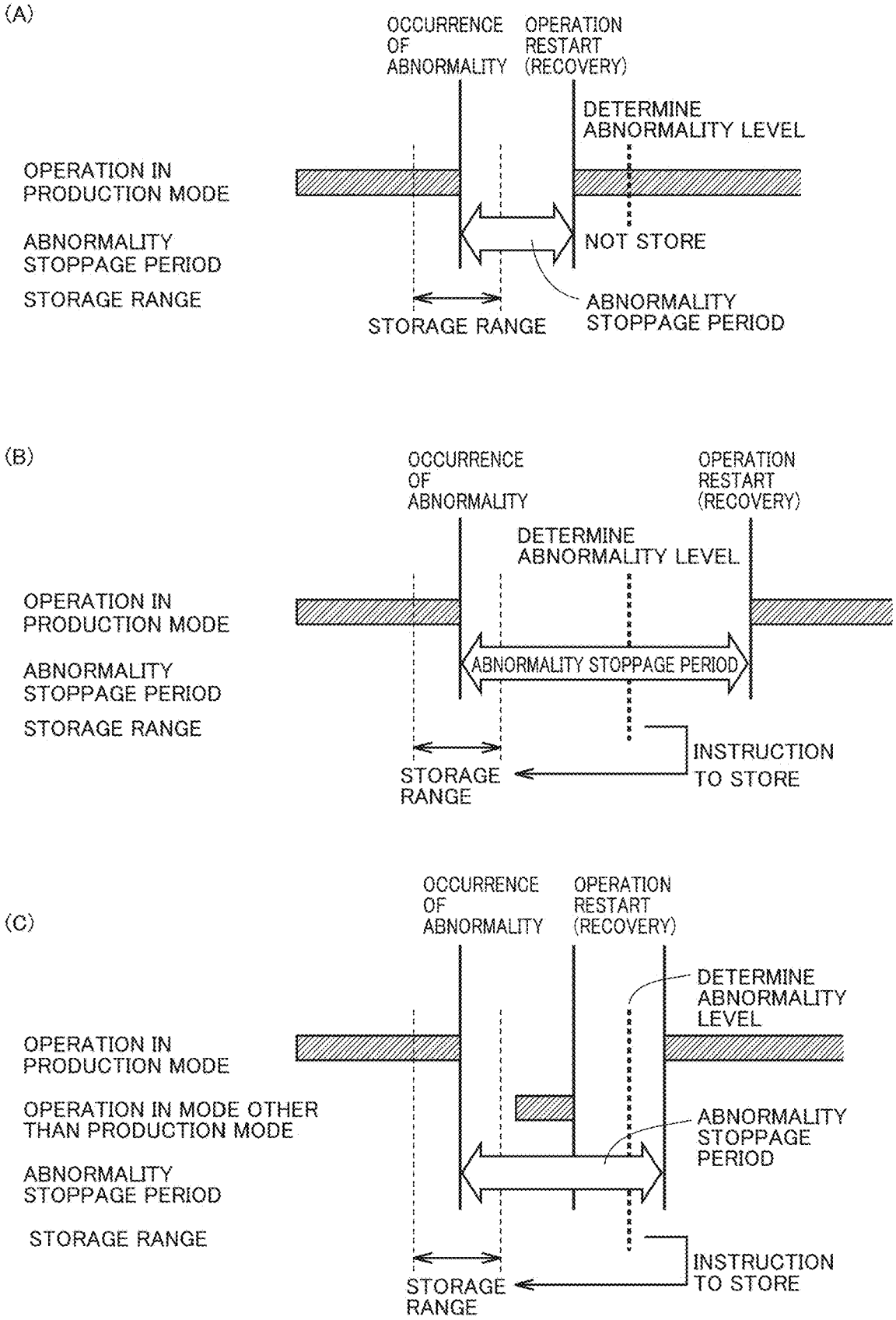
FIGS. 7A, 7B, and 7C are diagrams illustrating specific examples of abnormality determination for press machine 10 according to the first embodiment.

Referring to FIG. 7 (A), a case is illustrated in which an abnormality occurs during press working in the production mode. In the illustrated case, the period from occurrence of the abnormality causing stoppage of press machine 10 to restart (recovery) of the operation (abnormality stoppage period) is shorter than a predetermined period.

In the case of this abnormality, the abnormality stoppage period is short, and therefore, in the abnormality level determination, it is determined that the abnormality level is low. In this case, the abnormality data stored in temporary memory 44 is not stored in memory 45. In the illustrated case, the sum of a predetermined range after occurrence of the abnormality and a predetermined range before the occurrence of the abnormality is a storage range of the abnormality data.

Referring to FIG. 7 (B), a case is illustrated in which the period from occurrence of an abnormality causing stoppage of press machine 10 to restart (recovery) of the operation (abnormality stoppage period) is a predetermined period or more.

In the case of this abnormality, the abnormality stoppage period is long, and therefore, in the abnormality level determination, it is determined that the abnormality level is high. In this case, the abnormality data stored in temporary memory 44 is stored in memory 45. In the illustrated case, the sum of a predetermined range after occurrence of the abnormality and a predetermined range before the occurrence of the abnormality is a storage range of the abnormality data.

Referring to FIG. 7 (C), a case is illustrated in which an operation in a mode other than the production mode is performed after occurrence of an abnormality causing stoppage of press machine 10. For example, in the illustrated case, an inching operation is performed for adjusting the slide height.

In this case, any operation in a mode other than the production mode is not regarded as restart of the pressing operation. In the illustrated case, the period in which the operation in a mode other than the production mode is performed is included in the abnormality stoppage period, and the period from occurrence of the abnormality to restart (recovery) of the pressing operation (abnormality stoppage period) is equal to or more than a predetermined period.

In this case, any operation in a mode other than the production mode is not restart (recovery) of the pressing operation, and therefore, when the abnormality stoppage period is long, it is determined that the abnormality level is high. In this case, abnormality data stored in temporary memory 44 is accordingly stored in memory 45. In the illustrated case, the storage range of the abnormality data is the sum of a predetermined range after occurrence of the abnormality and a predetermined range before the occurrence of the abnormality. In this way, an erroneous determination is prevented, namely the abnormality level of an abnormality that may be determined to be high is prevented from being erroneously determined to be low. The accuracy of the determination can thus be enhanced.

<Control Flow>

Figure 8:
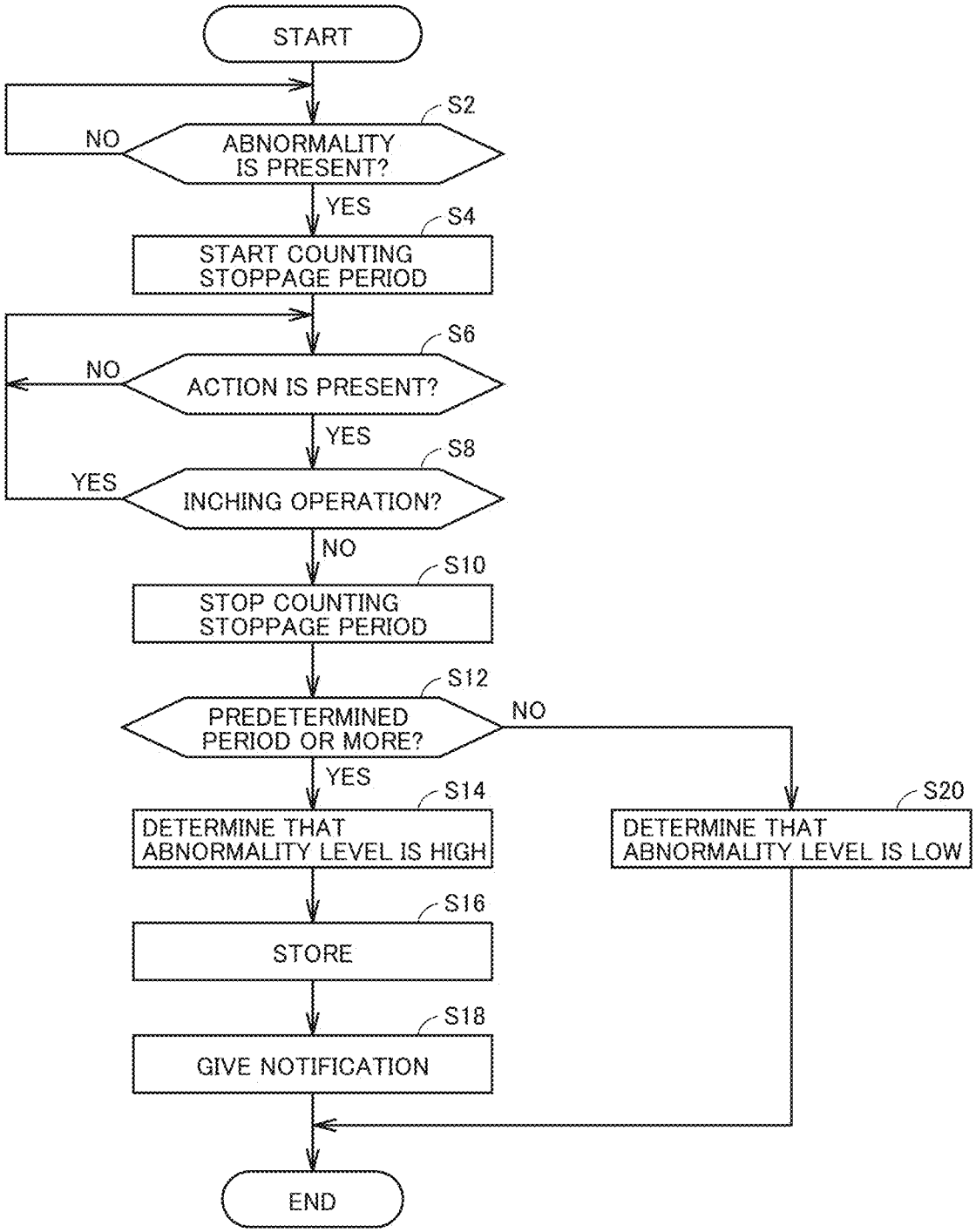
FIG. 8 is a diagram illustrating a flow of a process for the abnormality level of the press system according to the first embodiment.

FIG. 8 is a diagram illustrating a flow of a process for the abnormality level of the press system according to the first embodiment. A program for implementing this flow is stored in memory 45 in advance, and the flow is implemented through execution of the program. The same is applied to flows described later herein.

As shown in FIG. 8, controller 40 determines whether an abnormality is present or not (step S2). Specifically, detection unit 402 determines whether sensor 50 has detected an abnormality.

When controller 40 determines that an abnormality is present (YES in step S2), controller 40 then starts counting a stoppage period (step S4). Specifically, detection unit 402 instructs count unit 412 to count a period for which press machine 10 is stopped due to the abnormality (abnormality stoppage period).

Controller 40 then determines whether an action is performed or not (step S6). Specifically, when press working is stopped due to occurrence of the abnormality, press control unit 400 restarts the operation after the abnormality is eliminated. When the operation is restarted by press control unit 400, it is determined that an action is performed.

When controller 40 determines in step S6 that an action is not performed (NO in step S6), controller 40 maintains this state. When controller 40 determines that an action is performed (YES in step S6), controller 40 determines whether the action is the inching operation or not (step S8). Specifically, press control unit 400 determines whether restart of the operation is start of the inching operation. This determination can be made based on whether the press machine is operated in the inching operation mode.

In step S8, when controller 40 determines that the action is not the inching operation (NO in step S8), controller 40 stops counting the stoppage period (step S10). Specifically, when the action is not the inching operation, press control unit 400 causes stoppage of counting by count unit 412 as the operation is restarted.

In contrast, when controller 40 determines in step S8 that the action is the inching operation (YES in step S8), controller 40 returns to step S6. Namely, the counting operation is not stopped. Specifically, when the inching operation is started, press control unit 400 does not instruct count unit 412 to stop counting.

Controller 40 then determines whether the stoppage period is equal to or more than a predetermined period (step S12). Specifically, abnormality determination unit 404 determines whether or not the counted abnormality stoppage period is a predetermined period or more.

When controller 40 determines that the stoppage period is a predetermined period or more (YES in step S12), controller 40 determines that the abnormality level is high (step S14). Specifically, when abnormality determination unit 404 determines that the abnormality stoppage period counted by count unit 412 is equal to or more than a predetermined period, it determines that the abnormality level is high. When it takes a long time to restart (recover) the pressing operation (the abnormality stoppage period is long), it can be determined that the abnormality level is high.

Controller 40 then performs a storage process (step S16). Specifically, abnormality storage unit 406 performs a storage process of storing abnormality data based on the result of the determination (the abnormality level is high) by abnormality determination unit 404.

Controller 40 then performs a notification process (step S18). Specifically, abnormality notification unit 416 gives a notification regarding the abnormality level based on the result of the determination (the abnormality level is high) by abnormality determination unit 404. For example, abnormality notification unit 416 causes the display of control panel 6 to indicate the fact that an error has occurred. Alternatively, abnormality notification unit 416 may output an error sound. Abnormality notification unit 416 may give a notification that abnormality data is stored, based on the result of the determination (the abnormality level is high) by abnormality determination unit 404.

The whole process is then completed (END).

In contrast, when controller 40 determines in step S12 that the stoppage period is not a predetermined period or more (NO in step S10), controller 40 determines that the abnormality level is low (step S20). Specifically, when abnormality determination unit 404 determines that the abnormality stoppage period counted by count unit 412 is not equal to or more than a predetermined period (less than a predetermined period), it determines that the abnormality level is low. When it does not take a long time to restart (recover) the pressing operation (the abnormality stoppage period is short), it can be determined that the abnormality level is low.

The whole process is then completed (END). In this case, the storage process and the abnormality notification process are therefore not performed. Based on the result of the determination (the abnormality level is low) by abnormality determination unit 404, abnormality storage unit 406 and abnormality notification unit 416 do not perform the process of storing abnormality data.

In the above-described processes, the abnormality level is determined based on the period for which the pressing operation is stopped (abnormality stoppage period) after occurrence of an abnormality. The abnormality level can thus be determined by the simple method.

When the abnormality stoppage period is long, it is determined that the abnormality level is high. When the abnormality stoppage period is short, it is determined that the abnormality level is low. Based on the determination about the magnitude (high/low) of the abnormality level, the abnormality data storage process is performed. It is thus possible to direct analysis to data regarding an abnormality having a high abnormality level, which facilitates the analysis process. Failure to store data regarding an abnormality having a low abnormality level is advantageous in terms of the storage capacity, and the capacity of the memory to be ensured can be reduced. Moreover, the process of giving a notification of abnormality data is performed based on the determination about the magnitude (high/low) of the abnormality level, and it is therefore possible to focus on data regarding an abnormality having a high abnormality level, which can suppress reduction of the work efficiency due to notification of an abnormality having a low abnormality level.

According to the foregoing description, abnormality notification unit 416 performs the process of giving a notification of an abnormality level, based on the result of the determination (the abnormality level is high) by abnormality determination unit 404. Abnormality notification unit 416, however, may further give a notification of the abnormality in addition to the abnormality level. Abnormality notification unit 416 may give a notification of one of the abnormality level and the abnormality. For example, abnormality notification unit 416 may give a notification of an abnormality regarding the fact that the period for which the pressing operation is stopped (abnormality stoppage period) is long.

<Storage of Abnormality Data>

Figure 9:
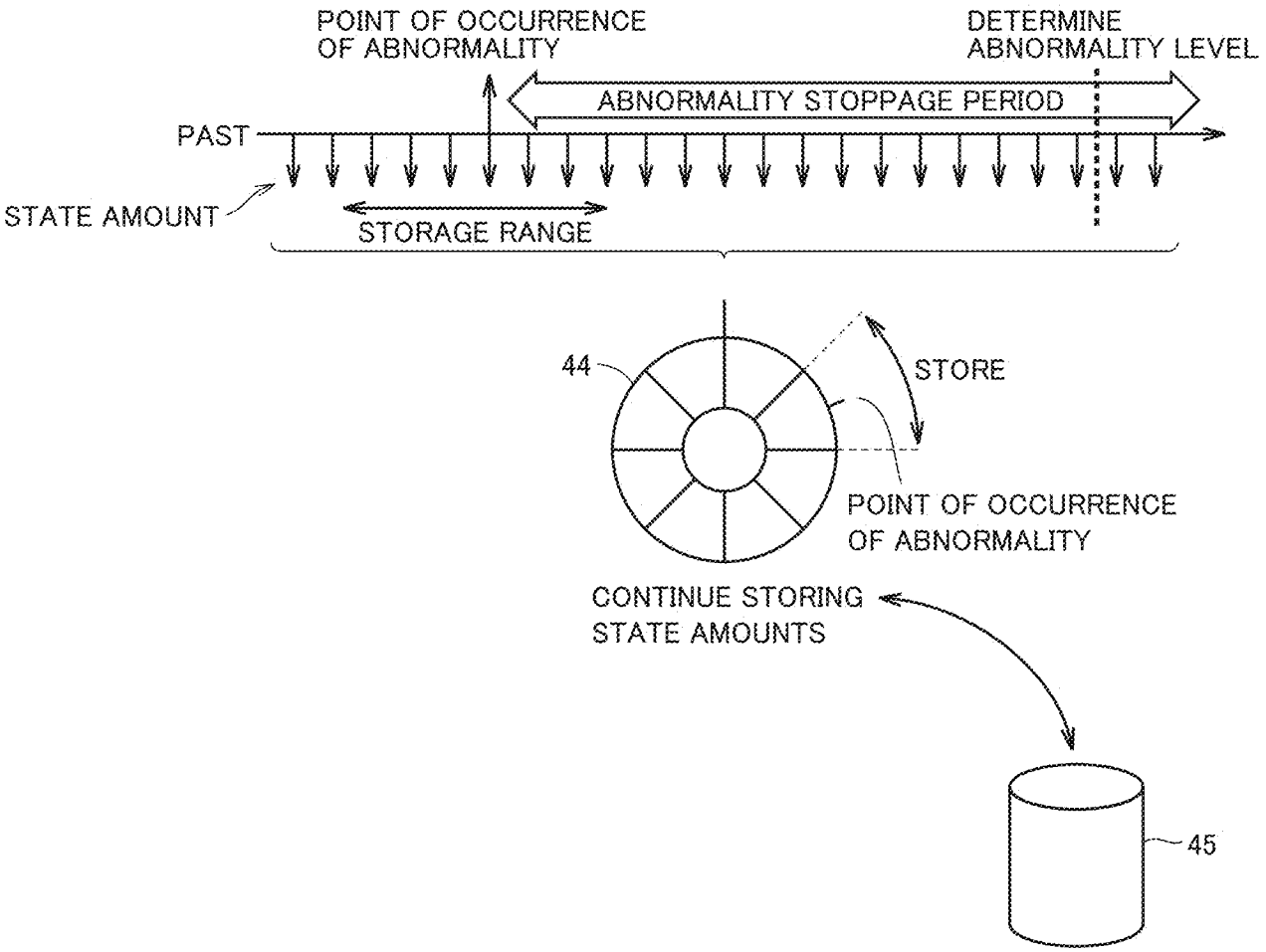
FIG. 9 is a conceptual diagram illustrating storage of abnormality data according to the first embodiment.

FIG. 9 is a conceptual diagram illustrating storage of abnormality data according to the embodiment.

As shown in FIG. 9, when the abnormality stoppage period is a predetermined period or more, it is determined that the abnormality level is high at "determine abnormality level."

As illustrated in the present example, state amounts are successively stored in temporary memory 44. Among these state amounts, a state amount in a predetermined range extending forward and backward from a point of occurrence of abnormality is specified as abnormality data. The abnormality data in the storage range is then stored in memory 45.

Whether to store the abnormality data in memory 45 or not is determined based on whether or not the abnormality stoppage period is a predetermined period or more.

Second Embodiment

Figure 10:
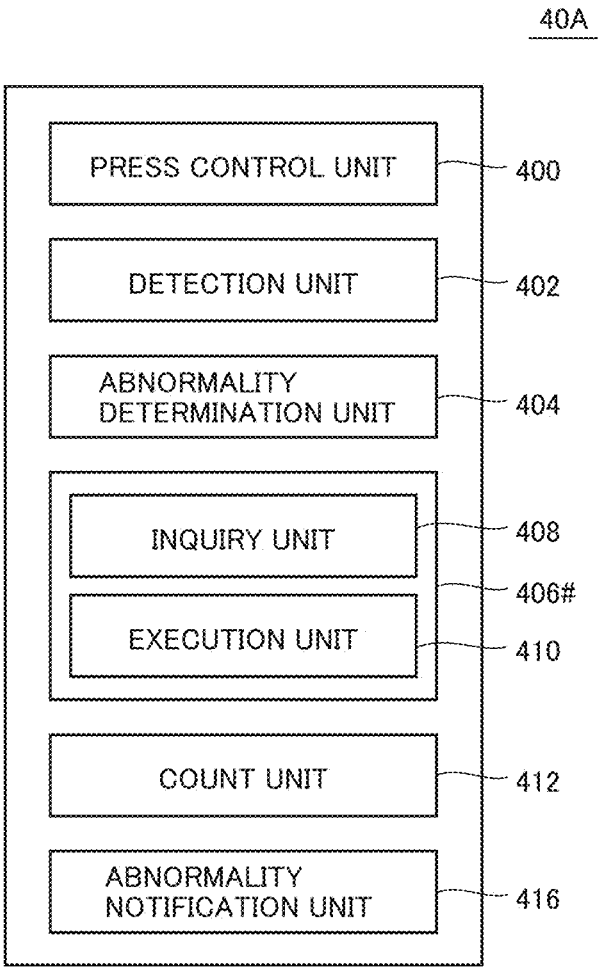
FIG. 10 is a diagram illustrating functional blocks of a controller 40A according to a second embodiment.

FIG. 10 is a diagram illustrating functional blocks of a controller 40A according to a second embodiment.

As shown in FIG. 10, controller 40A differs from controller 40 illustrated in FIG. 6 in that the former includes an abnormality storage unit 406# instead of abnormality storage unit 406. Other elements are similar to those described above in connection with FIG. 6, and the detailed description thereof will not be repeated.

Abnormality storage unit 406# includes an inquiry unit 408 and an execution unit 410.

Inquiry unit 408 makes an inquiry to a user about whether to store abnormality data or not. Inquiry unit 408 also receives an answer to the inquiry from the user. Specifically, inquiry unit 408 causes an inquiry screen to be presented on the display of control panel 6.

Execution unit 410 executes a storage process based on the answer from the user to inquiry unit 408.

Figure 11:
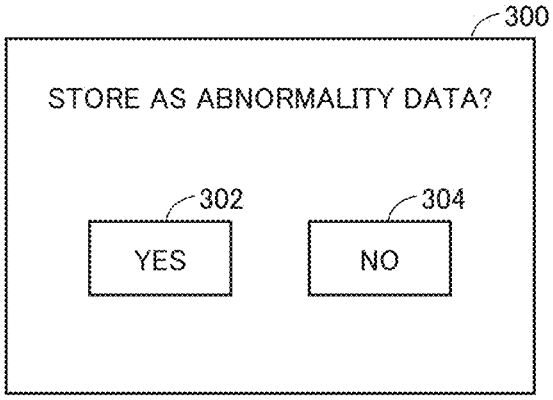
FIG. 11 is a diagram illustrating an inquiry screen according to the second embodiment.

FIG. 11 is a diagram illustrating the inquiry screen according to the second embodiment.

As shown in FIG. 11, inquiry unit 408 instructs the display of control panel 6 to present an inquiry screen 300.

In the illustrated inquiry screen 300, a message "STORE AS ABNORMALITY DATA?" as well as a "YES" button 302 and a "NO" button 304 are included.

When "YES" button 302 is selected, inquiry unit 408 accepts the instruction to store abnormality data.

When "NO" button 304 is selected, inquiry unit 408 accepts the instruction not to store abnormality data.

Inquiry unit 408 gives an instruction to execution unit 410 following the user's instruction to store or not to store.

Specifically, when inquiry unit 408 receives an instruction to store through selection of "YES" button 302, inquiry unit 408 instructs execution unit 410 to store. Execution unit 410 then stores, in memory 45, abnormality data stored in temporary memory 44.

In contrast, when inquiry unit 408 receives an instruction not to store through selection of "NO" button 304, inquiry unit 408 does not instruct execution unit 410 to store. In this case, execution unit 410 does not store, in memory 45, abnormality data stored in temporary memory 44.

For example, after press machine 10 detects an abnormality and stops its pressing operation, a user may not immediately perform a recovery operation even when the abnormality is minor abnormality and leave press machine 10.

In the first embodiment, it is determined that the abnormality level is high when the abnormality stoppage period is a predetermined period or more. Therefore, even when the abnormality is minor abnormality, the abnormality level may be determined to be high depending on the timing when the recovery operation is performed. Accordingly, abnormality data is stored in memory 45.

In view of the above, an inquiry is made to the user about whether to store data or not, to thereby enable reliable storage of abnormality data regarding an abnormality having a high abnormality level, excluding minor abnormality.

Figure 12:
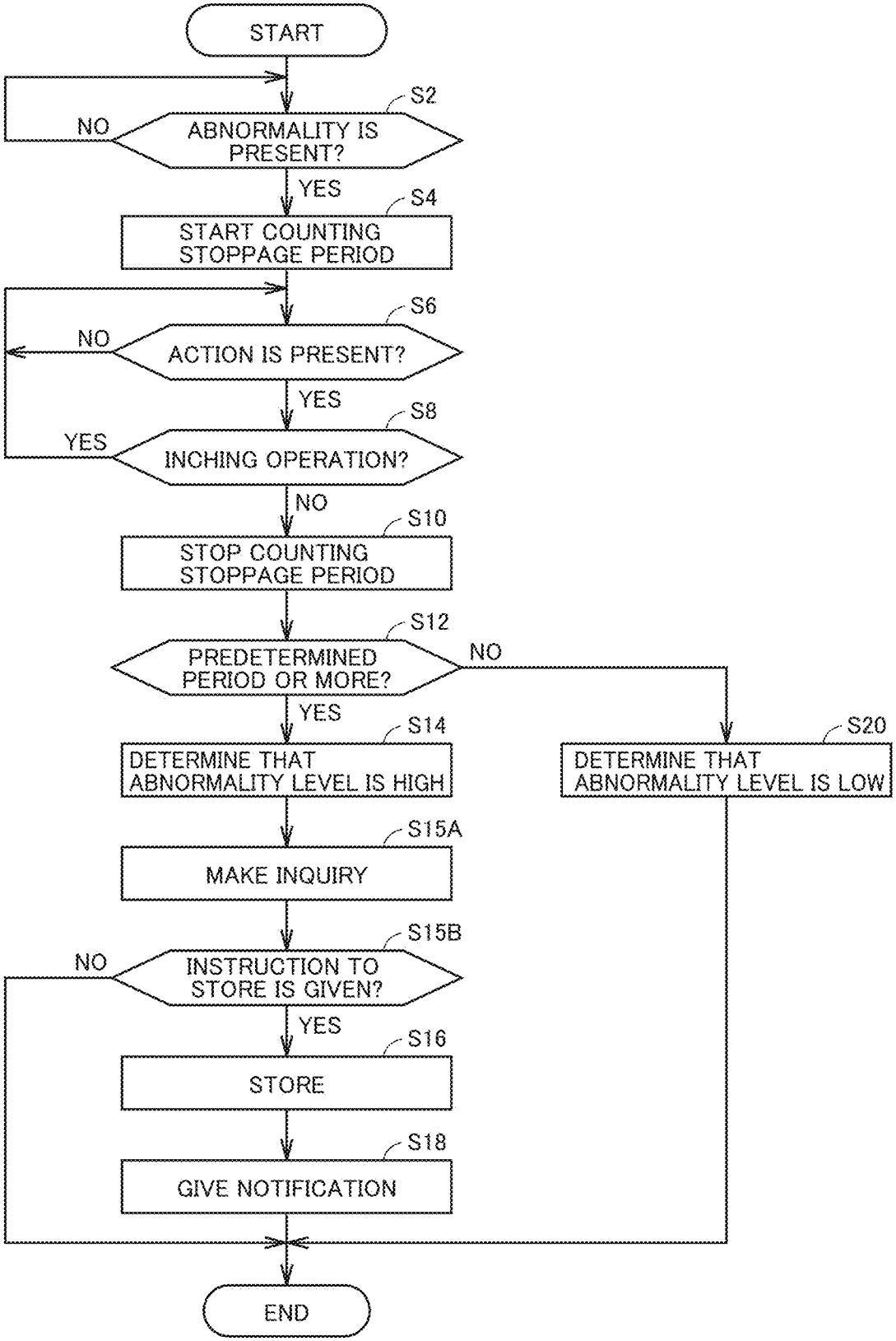
FIG. 12 is a diagram illustrating a flow of a process for the abnormality level of the press system according to the second embodiment.

FIG. 12 is a diagram illustrating a flow of a process for the abnormality level of a press system according to the second embodiment.

As shown in FIG. 12, the flow diagram differs from the flow diagram illustrated in FIG. 8 in that the former additionally includes steps S15A and S15B. Other steps are similar to those described above with reference to FIG. 8, and the detailed description thereof will not be repeated.

After determining that the abnormality level is high in step S14, controller 40 performs an inquiry process (step S15A). Specifically, inquiry unit 408 instructs the display of control panel 6 to present inquiry screen 300 illustrated in FIG. 11.

Controller 40 then determines whether an instruction to store is given or not (step S15B). Specifically, inquiry unit 408 determines whether an instruction to store is received from a user or not through selection of "YES" button 302 in inquiry screen 300.

When controller 40 determines that an instruction to store is given (YES in step S15B), controller 40 performs a storage process (step S16). Specifically, following the instruction to store, execution unit 410 stores, in memory 45, abnormality data stored in temporary memory 44.

In contrast, when controller 40 determines that the instruction to store is not given (NO in step S15B), controller 40 skips steps S16 and S18 to complete the whole process (END). Specifically, the storage process of abnormality storage unit 406# and the notification process of abnormality notification unit 416 are not performed.

Thus, an inquiry can be made to a user about whether to store data or not to thereby confirm the intention to store and reliably store abnormality data regarding an abnormality having a high abnormality level.

Third Embodiment

Figure 13:
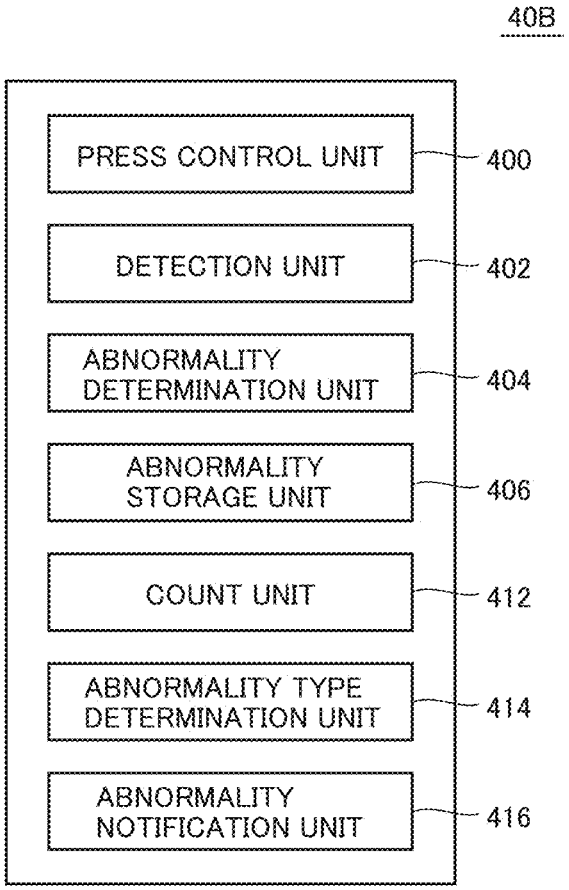
FIG. 13 is a diagram illustrating functional blocks of a controller 40B according to a third embodiment.

FIG. 13 is a diagram illustrating functional blocks of a controller 40B according to a third embodiment.

As shown in FIG. 13, controller 40B differs from controller 40 illustrated in FIG. 6 in that the former further includes an abnormality type determination unit 414. Other elements are similar to those described above with reference to FIG. 6, and the detailed description thereof will not be repeated.

Abnormality type determination unit 414 determines the abnormality type of the abnormality detected by detection unit 402.

Figure 14:
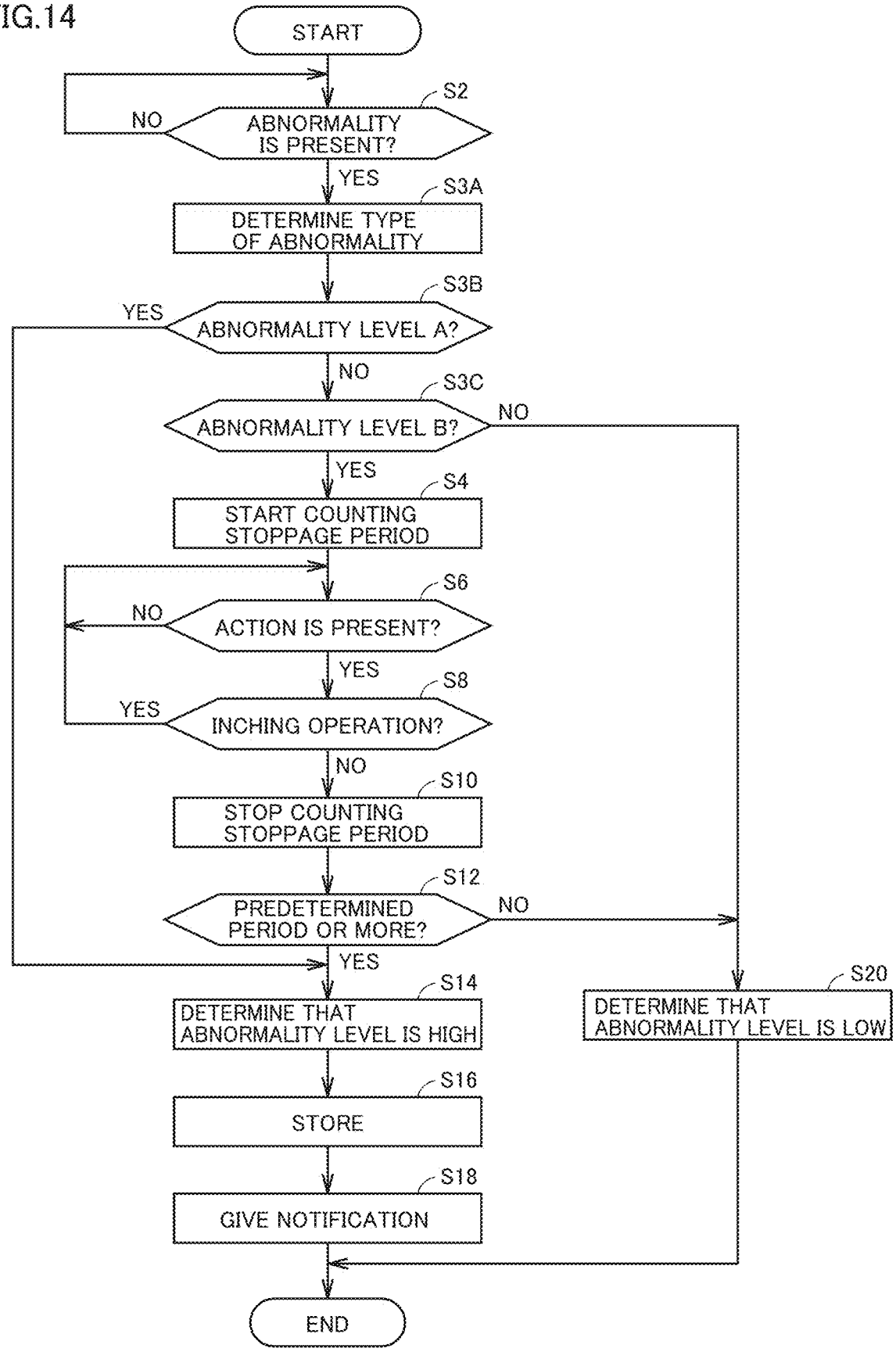
FIG. 14 is a diagram illustrating a flow of a process for the abnormality level of the press system according to the third embodiment.

FIG. 14 is a diagram illustrating a flow of a process for the abnormality level of the press system according to the third embodiment.

As shown in FIG. 14, the flow diagram differs from the flow diagram illustrated in FIG. 8 in that the former additionally includes steps S3A, S3B, and S3C. Other steps are similar to those described above with reference to FIG. 8, and the detailed description thereof will not be repeated.

When controller 40 determines that an abnormality is present (YES in step S2), controller 40 determines the abnormality type (step S3A). Specifically, abnormality type determination unit 414 determines the type of the abnormality detected by detection unit 402.

FIG. 15 is a diagram illustrating classification of abnormality types according to the third embodiment.

As shown in FIG. 15, abnormalities are classified into three types, namely abnormality levels A to C. Abnormality level A is classified into a class of abnormality of higher importance, and abnormality level C is classified into a class of abnormality of lower importance.

Specifically, an encoder abnormality is shown as an example of abnormality level A.

An overload abnormality is shown as an example of abnormality level B.

A battery abnormality is shown as an example of abnormality level C.

The types of abnormalities are given herein by way of example, and may also include other types of abnormalities.

In the present example, it is supposed that the abnormality type of the abnormality can be determined from a detection signal from a sensor, by way of example. For example, in response to a detection signal from a sensor configured to detect an encoder abnormality, it can be determined that the type of the abnormality is encoder abnormality.

In response to a detection signal from a sensor configured to detect an overload abnormality, it can be determined that the type of the abnormality is overload abnormality.

In response to a detection signal from a sensor configured to detect a voltage or current abnormality of a battery, it can be determined that the type of the abnormality is battery abnormality.

Based on a detection signal from a sensor detected by detection unit 402, abnormality type determination unit 414 determines the abnormality type (abnormality level A, B, C).

Referring again to FIG. 14, controller 40 then determines whether the abnormality type is abnormality level A or not (step S3B).

When controller 40 determines in step S3B that the abnormality type is abnormality level A (YES in step S3B), controller 40 proceeds to step S14 and determines that the abnormality level is high. The subsequent steps are similar to those described above with reference to FIG. 8.

In contrast, when controller 40 determines in step S3B that the abnormality type is not abnormality level A (NO in step S3B), controller 40 then determines whether the abnormality type is abnormality level B or not (step S3C).

When controller 40 determines in step S3C that the abnormality type is abnormality level B (YES in step S3C), controller 40 proceeds to step S4 and starts counting the stoppage period (step S4). The subsequent steps are similar to those described above with reference to FIG. 8.

In contrast, when controller 40 determines in step S3C that the abnormality type is abnormality level C (NO in step S3C), controller 40 proceeds to step S20 and determines that the abnormality level is low. The subsequent steps are similar to those described above with reference to FIG. 8.

In the system in accordance with the second embodiment, the abnormality level is determined taking the abnormality type into consideration, which enables the abnormality level to be determined with higher accuracy. Moreover, the abnormality level that is determined easily from the abnormality type is determined based on the abnormality type, which enables efficient determination.

Moreover, the abnormality data is stored depending on the abnormality type and therefore, necessary data is stored, which enables efficient storage of abnormality data.

According to the foregoing description, abnormality type determination unit 414 determines the abnormality type according to the method by which the abnormality type is determined based on a detection signal from a sensor. The method, however, is not limited to this. The abnormality type may be determined based on a state amount when an abnormality occurs. The method, however, is not limited to this.

Other Forms

Figure 16:
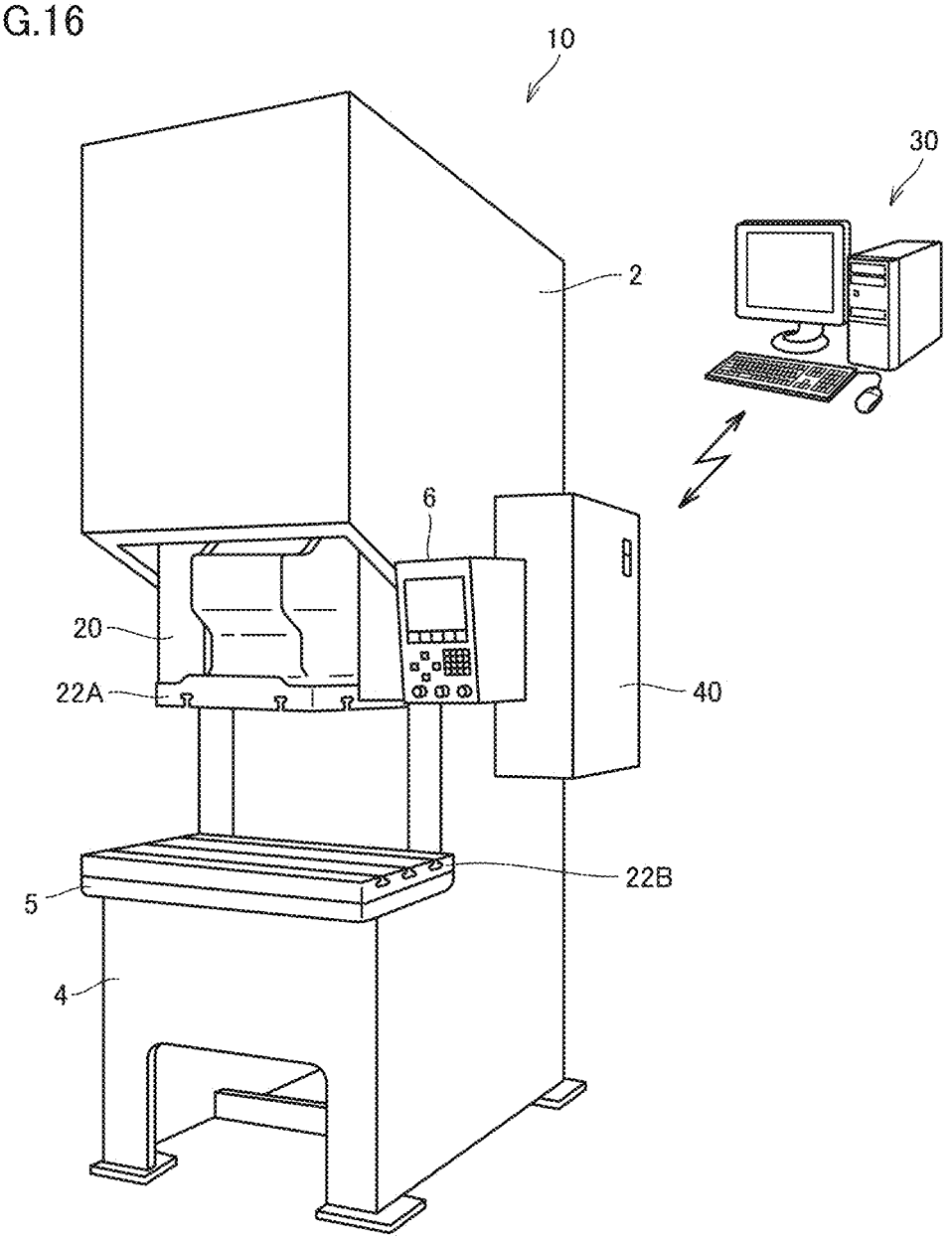
FIG. 16 is a diagram illustrating another form of the press system according to an embodiment.

FIG. 16 is a diagram illustrating another form of the press system according to an embodiment.

As shown in FIG. 16, an external device 30 configured to be capable of communicating with a press machine 10 is provided. As an example of external device 30, a server can be used.

According to the foregoing description of the embodiments, abnormality notification unit 416 of press machine 10 causes the display of control panel 6 to indicate the fact that an error has occurred. Indication of an error is not particularly limited to this, and a notification of an abnormality level can be transmission of the abnormality level to external device 30.

Specifically, abnormality notification unit 416 may transmit abnormality data to external device 30. This process allows external device 30 to receive the abnormality data transmitted from press machine 10, and accordingly external device 30 can perform an analysis based on the acquired abnormality data. In this way, an analysis of reasons for a long time taken for recovery by press machine 10, for example, can be performed at an earlier stage.

In another embodiment, at least a part of information processing performed by press machine 10 may be distributed processing among a plurality of devices capable of communicating with one another through a network (wide area network and/or local network). For example, a part of the processing can be performed by external device 30.

For example, the function of abnormality determination unit 404 may be assigned to external device 30. For example, abnormality determination unit 404 of external device 30 may receive an abnormality occurrence signal generated by press machine 10 and determine the abnormality level based on an abnormality stoppage period (information about the stoppage period) and the abnormality occurrence signal. Based on the result of the determination by abnormality determination unit 404 of external device 30, notification instruction data for instructing to give a notification of at least one of the abnormality and the abnormality level may be transmitted to press machine 10. Receiving the notification instruction data, press machine 10 may give a notification of at least one of the abnormality and the abnormality level. The abnormality stoppage period may be counted by external device 30 or the result of counting by press machine 10 may be used.

According to the foregoing description of the embodiments, the abnormality level is determined after the operation is restarted. The embodiments are not limited to this, and the abnormality level may be determined when it is determined that the abnormality stoppage period has reached a predetermined period or more and accordingly abnormality data may be stored.

In this case, press machine 10 may perform a process of giving a notification of (transmitting) abnormality data to external device 30 to thereby determine the abnormality of press machine 10 at an earlier stage.

According to the foregoing description of the embodiments, whether the abnormality level is high or low is determined based on whether the abnormality stoppage period is a predetermined period or more. The embodiments, however, are not limited to this. A plurality of predetermined periods may be specified as threshold values of the abnormality stoppage period and the abnormality levels may be further classified into finer levels. This process enables the abnormality level to be determined with still higher accuracy.

While the foregoing is described as being applicable to the progressive-type press machine, it is also applicable to the transfer-type press machine as well and also applicable to other press machines as well, without limited to the transfer-type press machine.

The above description of the present example is of functions of controller 40 provided in the press machine. The functions, however, are not limited to the press machine, but may be functions of a press system including the press machine. When the press machine/system is connected through a network to an external server, the functions may be performed in cooperation with a CPU of the external server. The indication on the display is not limited to indication on the display of the press machine, and may be indication on a display of a terminal connectable to the press machine through a network.

It should be construed that embodiments disclosed herein are given by way of illustration in all respects, not by way of limitation. It is intended that the scope of the present invention is defined by claims, not by the description above, and encompasses all modifications and variations equivalent in meaning and scope to the claims.

REFERENCE SIGNS LIST

2 body frame; 4 bed; 5 bolster; 6 control panel; 10 press machine; 20 slide; 30 external device; 32A upper die; 32B lower die; 40 controller; 44 memory; 46 communication circuit; 400 press control unit; 402 detection unit; 404 abnormality determination unit; 406, 406# abnormality storage unit; 408 inquiry unit; 410 execution unit; 412 count unit; 414 abnormality type determination unit; 416 abnormality notification unit; 70 remote controller; 100 uncoiler; 110 main shaft; 110A eccentric portion; 115 main gear; 200 leveler feeder

The invention claimed is:

1. A press system comprising:

a press machine for press working of a workpiece; and a controller for controlling operation of the press machine, the controller configured to:

detect an occurrence of an abnormality of the press machine during press working of the workpiece based on a detection signal from at least one abnormality sensor of the pressing machine that detects the abnormality of the pressing machine;

stop the press working of the workpiece by the press machine based on the occurrence of the abnormality;

detect a stoppage period from when the press working of the workpiece by the press machine is stopped after the occurrence of the abnormality to when the abnormality is resolved and a press operation of the press machine is restarted;

upon detecting the occurrence of the abnormality, count the stoppage period from when the press working of the work piece by the press machine is stopped after the occurrence of the abnormality to when the abnormality is resolved and the press operation of the press machine is restarted, wherein, when a predetermined pressing operation of the press machine is performed, counting the stoppage period does not stop, and wherein, when the predetermined pressing operation of the press machine is not performed, counting the stoppage period stops; and determine an abnormality level based on a length of the stoppage period.

2. The press system according to claim 1, wherein the controller is further configured to:

provide a notification of at least one of the detected occurrence of the abnormality and the determined abnormality level.

3. The press system according to claim 1, wherein the controller is further configured to:

store at least one of i) the detected occurrence of the abnormality and ii) the determined abnormality level as abnormality data.

4. The press system according to claim 3, wherein the controller is further configured to:

determine an abnormality type of the detected occurrence of the abnormality, wherein storing the abnormality data includes storing the determined abnormality type and the determined abnormality level as the abnormality data.

5. The press system according to claim 3, wherein storing at least one of i) the detected abnormality and ii) the determined abnormality level as abnormality data includes:

inquiring a user whether to store the abnormality data; and storing the abnormality data based on a response to inquiring the user.

6. A control method for a press system, the control method comprising:

receiving an abnormality occurrence signal from at least one abnormality sensor of a press machine that detects an abnormality of the press machine during press working of a workpiece by the press machine;

stopping the press working of the workpiece by the press machine based on the abnormality occurrence signal;

detecting a stoppage period from when the press working of the workpiece by the press machine is stopped after a generation of the abnormality occurrence signal to when an abnormality of the abnormality occurrence signal is resolved and a press operation of the press machine is restarted;

upon detecting the occurrence of the abnormality, counting the stoppage period from when the press working of the work piece by the press machine is stopped after the occurrence of the abnormality to when the abnormality is resolved and the press operation of the press machine is restarted, wherein, when a predetermined pressing operation of the press machine is performed, counting the stoppage period does not stop, and wherein, when the predetermined pressing operation of the press machine is not performed, counting the stoppage period stops; and determining an abnormality level based on a length of the stoppage period.

7. The control method for a press system according to claim 6, the control method further comprising:

transmitting a notification of at least one of i) the generation of the abnormality occurrence signal and ii) the abnormality level.

8. The press system according to claim 1, wherein the predetermined pressing operation is an inching operation, and wherein the controller is further configured to:

during counting the stoppage period, determine whether the inching operation is performed by the press machine;

when the inching operation is determined to be performed by the press machine, continue to count the stoppage period; and when the inching operation is determined not to be performed by the press machine, stop counting the stoppage period.

9. A press system comprising:

a press machine for press working of a workpiece; and a controller for controlling operation of the press machine, the controller configured to:

detect an occurrence of an abnormality of the press machine during press working of the workpiece;

stop the press working of the workpiece by the press machine based on the occurrence of the abnormality;

upon detecting the occurrence of the abnormality, count a stoppage period from when the press working of the work piece by the press machine is stopped after the occurrence of the abnormality to when the abnormality is resolved and a press operation of the press machine is restarted;

during counting the stoppage period, determine whether an inching operation is performed by the press machine;

when the inching operation is determined to be performed by the press machine, continue to count the stoppage period;

when the inching operation is determined not to be performed by the press machine, stop counting the stoppage period; and determine an abnormality level based on a length of the stoppage period.

* * * * *